United States Patent [19]

Uemura et al.

[11] Patent Number: 4,849,200

[45] Date of Patent: Jul. 18, 1989

[54] PROCESS FOR FABRICATING CARBON/CARBON COMPOSITE

[75] Inventors: Seiichi Uemura, Tokyo; Yoshio Sohda, Kawasaki; Yasuji Ido, Yokohama; Shunichi Yamamoto, Kamakura, all of Japan

[73] Assignee: Nippon Oil Company, Limited, Japan

[21] Appl. No.: 176,713

[22] Filed: Apr. 1, 1988

[30] Foreign Application Priority Data

Apr. 3, 1987 [JP] Japan ..... 62-81250
Jul. 22, 1987 [JP] Japan ..... 62-180979

[51] Int. Cl.[4] ..... D01F 9/14

[52] U.S. Cl. ..... 423/447.4; 264/29.2; 423/442.1; 423/447.2; 423/447.6; 252/502

[58] Field of Search ..... 423/447.1, 447.2, 447.4, 423/447.6; 264/29:5; 252/502

[56] References Cited

U.S. PATENT DOCUMENTS

| | | | |
|---|---|---|---|
| 3,407,038 | 10/1968 | Beasley | 423/447.2 |
| 3,541,582 | 11/1970 | Johnson et al. | 423/447.6 |
| 3,809,673 | 5/1974 | White et al. | 264/29.5 |
| 3,859,158 | 1/1975 | Park | 423/447.1 |
| 4,014,725 | 3/1977 | Schulz | 423/447.6 |
| 4,032,607 | 6/1977 | Schulz | 423/447.4 |
| 4,193,252 | 3/1980 | Shepherd et al. | 423/447.1 |
| 4,201,611 | 5/1980 | Stover | 264/29.5 |
| 4,396,663 | 8/1983 | Mitchell et al. | 423/447.4 |
| 4,628,001 | 12/1986 | Sasaki et al. | 423/447.4 |
| 4,659,624 | 4/1987 | Yeager et al. | 423/447.4 |
| 4,686,096 | 8/1976 | Schulz et al. | 423/447.4 |

*Primary Examiner*—John Doll
*Assistant Examiner*—Robert M. Kunemund
*Attorney, Agent, or Firm*—Scully, Scott, Murphy & Presser

[57] ABSTRACT

A process for fabricating a carbon/carbon fiber composite characterized in that one or more kinds of fibers selected from the group consisting of a pitch fiber obtained by spinning a carbonaceous pitch, an infusiblized fiber obtained by subjecting the pitch fiber to an infusiblizing treatment, and a pre-carbonized fiber obtained by subjecting the infusiblized fiber to a pre-carbonizing fiber at 400° to 800° C. in an inert gas atmosphere, are woven, laminated or mix-pulverized together with a pitch-based carbon fiber, and then carbonized under the application of pressure or under pressing.

12 Claims, No Drawings

PROCESS FOR FABRICATING CARBON/CARBON COMPOSITE

BACKGROUND OF THE INVENTION

The present invention relates to a process for producing a carbon/carbon composite.

Carbon/carbon composites have unique properties; for example, even at high temperatures above 1000° C. they maintain high strength and high modulus and exhibit small thermal expansion coefficient. Their utilization is expected as materials for aerospace, brakes and other high temperature uses. Carbonaceous pitch has been used as a precursor for the matrix of a carbon/carbon composite. But, if there is used a carbonaceous pitch of a low softening point, the carbonization yield will become low and bubbles will be formed in the matrix due to a volatile component formed during carbonization. On the other hand, if there is used a carbonaceous pitch of a high softening point, it will become difficult to effect uniform impregnation of the pitch into a tow of carbon fibers. Although various proposals have been made to avoid such inconveniences, the manufacturing process is complicated and the cost is high because considerable days are required.

SUMMARY OF THE INVENTION

It is the object of the present invention to overcome the above-mentioned drawbacks of the prior art and provide a simple process for producing a carbon/carbon composite of good quality.

The present invention resides in a process for producing a carbon/carbon composite, characterized in that one or more kinds of fibers selected from the group consisting of a pitch fiber obtained by spinning a carbonaceous pitch, an infusibilized fiber obtained by subjecting the pitch fiber to an infusibilizing treatment and a precarbonized fiber obtained by subjecting the infusibilized fiber to a pre-carbonizing treatment at 400°-800° C. in an inert gas atmosphere, are woven, laminated or mix-pulverized together with a pitch-based carbon fiber and then carbonized under the application of pressure or under pressing.

DESCRIPTION OF THE PREFERRED EMBODIMENTS

The carbon/carbon composite producing method of the present invention will be described in detail hereinunder.

As carbonaceous pitch used for the production of pitch-based carbon fiber there is used a coal or petroleum pitch having a softening point of 100° to 400° C., preferably 150° to 350° C.

Employable carbonaceous pitches include both optically isotropic and anisotropic pitches. But an optically anisotropic pitch having an optically anisotropic phase content of 60% to 100% is particularly preferred.

The "pitch fiber" as referred to herein represents a fiber having an average diameter of 5 to 100 μm, preferably 7 to 30 μm, obtained by melt-spinning the above mentioned carbonaceous pitch in a known manner.

The "infusibilized fiber" as referred to herein represents an infusibilized fiber obtained by subjecting the above pitch fiber to an infusibilizing treatment. The infusibilizing treatment can be performed at 50° to 400° C., preferably 100° to 350° C., in an oxidative gas atmosphere. As the oxidative gas there may be used air, oxygen, nitrogen oxides, sulfur oxides, a halogen, or a mixture thereof. This treatment is conducted for 10 minutes to 20 hours.

The "pre-carbonized fiber" as referred to herein represents a fiber obtained by subjecting the infusibilized fiber to a pre-carbonizing treatment. The pre-carbonizing treatment is carried out at 400° to 800° C. in an inert gas atmosphere for 10 minutes to 5 hours.

The "pre-carbonized fiber" as referred to herein represents a fiber obtained by subjecting the infusibilized fiber to a pre-carbonizing treatment. The pre-carbonizing treatment is carried out at 400° to 800° C. in an inert gas atmosphere for 10 minutes to 5 hours.

The "pitch-based carbon fiber" as referred to herein represents a fiber obtained by melt-spinning a carbonaceous pitch and subjecting the resulting pitch fiber to infusibilization, carbonization and, if necessary, graphitization. The carbonaceous pitch, melt spinning and infusibilization as referred to herein are as already mentioned above. The carbonizing treatments and the graphitizing treatment can be carried out at respectively at 800°-2000° C. and 2000°-3000° C. in an inert gas atmosphere.

One or more kinds of fibers selected from the group consisting of the pitch fiber, the infusibilized fiber and the pre-carbonized fiber, and the pitch-based carbon fiber, are woven, laminated or pulverized together, then carbonized under the application of pressure or under pressing, and, if necessary, further carbonized or graphitized at atmospheric pressure. At the time of weaving or lamination each fiber can be used as a tow of 500 to 10,000 filaments. Further, before the lamination, the pitch fiber, the infusibilized fiber or the pre-carbonized fiber may be chopped to 2-5,000, preferably 10-3,000 in terms of aspect ratio (l/d). The mix-pulverization may be carried out either by mixing and pulverizing 20-95 parts by weight, preferably 30-90 parts by weight, of one or more kinds of fibers selected from the group consisting of the pitch fiber, the infusibilized fiber and the pre-carbonized fiber together with 5-80 parts by weight, preferably 10-70 parts by weight, of the pitch-based carbon fiber, or by pulverizing the above fibers separately and then mixing each other. The aspect ratio (l/d) of the both pulverized fibers may be 2-5,000, preferably 10-3,000. Preferably the l/d of the infusibilized fiber or the precarbonized fiber is less than the l/d of the pitch-based carbon fiber.

The carbonization under the application of pressure is carried out at 400° to 2,000° C. under the application of isostatic pressure in the range of 50 to 10,000 kg/cm$^2$ using an inert gas. The carbonization under pressing is carried out at 400° to 2,000° C. at a uniaxial pressure of 10 to 500 kg/cm$^2$ using a hot press. The carbonization or graphitization at atmospheric pressure which, if necessary, follows the carbonization under the application of pressure or under pressing, is carried out at 400° to 3,000° C. in an inert gas atmosphere.

The volume fraction (Vf) of the pitch-based carbon fiber in the composite material is decided according to purposes, but usually it is in the range of 5% to 70%.

The following examples are given to explain the present invention concretely.

Example 1

An optically anisotropic petroleum pitch having a softening point of 280° C. was melt-spun into pitch fibers having an average diameter of 13 μm. A 2,000 filaments tow of the pitch fibers and a 2,000 filaments tow of pitchbased carbon fibers having an average diameter of 10 μm were subjected to plain-weaving. The resulting fabric was laminated in 100 layers at 600° C. under pressing at a pressure of 100 kg/cm$^2$ using a hot press. The carbonized material was calcined at 1,000° C. in a nitrogen atmosphere for 30 minutes to obtain a carbon/carbon composite having a volume content of fibers of 50% and a void percentage of 10%. An extremely uniform distribution of the pitch in the matrix was observed using a polarized microscope or an electron microscope.

Comparative Example 1

An optically anisotropic petroleum pitch having a softening point of 280° C. was pulverized and laminated in 100 layers alternately with a plain weave fabric obtained from a 2,000 filaments tow of pitch-based carbon fibers having an average diameter of 10 μm. The resulting laminate was carbonized at 600° C. under pressing at a pressure of 100 kg/cm$^2$ using a hot press. The thus carbonized material was calcined at 1,000° C. in a nitrogen atmosphere for 30 minutes to obtain a carbon/carbon composite having a volume content of fibers of 50% and a void percentage of 30%. Upon observation using a polarizing microscope or an electron microscope it was confirmed that the pitch was not uniformly distributed in the matrix.

EXAMPLE 2

The fabric obtained in Example 1 was laminated in 100 layers, then pressurized to 200 kg/cm$^2$ using an inert gas and carbonized at 550° C. for 1 hour and then calcined at 1,300° C., at atmospheric pressure, for 30 minutes to obtain a carbon/carbon composite having a volume content of fibers of 50% and a void percentage of 10%. An extremely uniform distribution of the pitch in the matrix was observed using a polarized microscope or an electron microscope.

EXAMPLE 3

An optically anisotropic petroleum pitch having a softening point of 280° C. was melt-spun into pitch fibers having an average diameter of 13 μm. A 2,000 filaments tow of the pitch fibers was rendered infusible at 300° C. in air for 1 hour. The fiber two thus infusibilized and a 2,000 filaments tow of pitch-based carbon fibers having an average diameter of 10 μm were subjected to plain-weaving. The resulting fabric was laminated in 100 layers hot pressed at 600° C. under pressing at a pressure of 100 kg/cm$^2$. The thus-carbonized material was heat-treated at 1,200° C. in a nitrogen atmosphere for 30 minutes to obtain a carbon/carbon composite having a fiber volume fraction of 50% and a void percentage less than 10%. An extremely uniform distribution of the pitch in the matrix was observed using a polarized microscope or an electron microscope.

EXAMPLE 4

The infusibilized fiber tow obtained in Example 3 was chopped to 40 in terms of aspect ratio and then laminated in 100 layers alternately with a plain fabric obtained from a 2,000 filaments tow of pitch-based carbon fibers having an average diameter of 10 μm. The resulting laminate was hot pressed at 600° C. under at a pressure of 100 kg/cm$^2$. The thus-carbonized material was heat-treated at 1,200° C. in a nitrogen atmosphere for 30 minutes to obtain a carbon/carbon composite having a fiber volume fraction of 50% and a void percentage less than 10%. An extremely uniform distribution of the pitch in the matrix was observed using a polarized microscope or an electron microscope.

EXAMPLE 5

An optically anisotropic petroleum pitch having a softening point of 280° C. was melt-spun into pitch fibers having an average diameter of 13 μm. A 2,000 filaments tow of the pitch fibers was rendered infusible at 300° C. in air for 1 hour. The fiber tow thus infusibilized and a 2,000 filaments tow of pitch-based carbon fibers having an average diameter of 10 μm were subjected to 8 harness satin-weaving. The resulting fabric was laminated in 20 layers and then carbonized at 600° C. under pressing at a pressure of 100 kg/cm$^2$ using a hot press. The thus-carbonized material was calcined at 1,200° C. in a nitrogen atmosphere for 30 minutes to obtain a carbon/carbon composite having a fiber volume fraction of 65% and a void percentage less than 5%. An extremely uniform distribution of the pitch in the matrix was observed using a polarized microscope or an electron microscope.

EXAMPLE 6

The infusibilized fiber tow obtained in Example 5 was chopped to 40 in terms of aspect ratio and then laminated in 20 layers alternately with a 2,000 filaments tow of pitch-based carbon fibers having an average diameter of 10 μm. The resulting laminate was carbonized at 600° C. under pressing at a pressure of 100 kg/cm$^2$ using a hot press. The thus-carbonized material was calcined at 1,200° C. in a nitrogen atmosphere for 30 minutes to obtain a carbon/carbon composite having a fiber volume fraction of 55% and a void percentage less than 10%. An extremely uniform distribution of the pitch in the matrix was observed using a polarized microscope or an electron microscope.

EXAMPLE 7

An optically anisotropic petroleum pitch having a softening point of 280° C. was melt-spun into pitch fibers having an average diameter of 13 μm. The pitch fibers thus obtained were rendered infusible at 280° C. in air for 30 minutes. 50 parts by weight of the resulting infusibilized fibers and 50 parts by weight of pitch-based carbon fibers having an average diameter of 10 μm which had obtained by calcined at 2000° C. were copulverized each other, and hot pressed at 1000° C. under a pressure of 100 kg/cm$^2$ for 30 minutes to obtain a carbon/carbon composite having a void percentage less than 5%. An extremely uniform distribution of the fibers was observed using a polarized microscope or an electron microscope.

EXAMPLE 8

The pitch fibers obtained in Example 7 were rendered infusible at 300° C. in air for 1 hour and heat-treated at 400° C. in a nitrogen atmosphere for 1 hour to obtain precarbonized fibers. The pre-carbonized fibers were pulverized to obtain fibers having a l/d of 10. 60 parts by weight of the fibers thus obtained and 40 parts by weight of fibers having a l/d of 50 which had been obtained by pulverizing the same pitch-based fibers as in Example 7 were hot-pressed at 600° C. under a pressure of 100 kg/cm$^2$ for 1 hour to obtain a carbonized product. The carbonized product was calcined at 1200° C. in a nitrogen atmosphere for 30 minutes to obtain a carbon material having a bulk density of 1.6 g/cc and a void percentage less than 10%. An extremely uniform distribution of the fibers was observed using a polarized microscope or an electron microscope.

EXAMPLE 9

The same infusibilized fibers as in Example 7 were heat-treated at 350° C. in a nitrogen atmosphere for 1 hour to obtain pre-carbonized fibers. The pre-carbonized fibers were pulverized to obtain fibers having a l/d of 10. 50 parts by weight of the fibers and 50 parts by weight of fibers having a l/d of 80 which had been obtained by pulverizing the same pitch-based carbon fibers as in Example 7 were mixed and prefabricated at room temperature and then carbonized in a stainless vessel at 1,000° C. under a pressure of 200 kg/cm$^2$ in a nitrogen atmosphere for 30 minutes to obtain a carbon material having a bulk density of 1.5 g/cc and a void percentage less than 5%. An extremely uniform distribution of the fibers was observed using a polarized microscope or an electron microscope.

What is claimed is:

1. A process for fabricating a carbon/carbon fiber composite comprising weaving, laminating or mix-pulverizing at least one type of fiber selected from the group consisting essentially of a pitch fiber obtained by spinning a carbonaceous pitch, an infusibilized fiber obtained by subjecting the pitch fiber to an infusibilizing treatment, and a pre-carbonized fiber obtained by subjecting the infusibilized fiber to a pre-carbonizing treatment at 400° to 800° C. in an inert gas atmosphere, together with a pitch-based carbon fiber obtained by carbonizing an infusibilized melt spun carbonaceous pitch at 800° to 2000° C. and graphitizing said carbonized pitch at 2000° to 3000° C. in an inert gas atmosphere; and carbonizing the resulting product under pressure.

2. A process as set forth in claim 1, wherein said carbonization under pressure is followed by carbonization or graphitization at atmospheric pressure.

3. A process as set forth in claim 1, wherein the carbonaceous pitch is an optically anisotropic pitch having an optically anisotropic phase content of 60% to 100%.

4. A process as set forth in claim 1, wherein the infusibilized fiber is obtained by rendering the pitch fiber infusible at 50° to 400° C. in an oxidative gas atmosphere.

5. A process as set forth in claim 1, wherein the fibers to be woven or laminated together are each made into a tow of 500 to 10,000 filaments and then woven or laminated together.

6. A process as set forth in claim 1, wherein a chopped strand of 2 to 5,000, in terms of aspect ratio, is used in the lamination of the pitch fiber, the infusibilized fiber or the pre-carbonized fiber.

7. A process as set forth in claim 1, wherein in the mix-pulverization the ratio of the one or more fibers to the pitch-based carbon fiber is 30–90 parts by weight to 5–80 parts by weight.

8. A process as set forth in claim 1, wherein during the mix-pulverization the aspect ratio of the infusibilized fiber of the pre-carbonized fiber is less than that of the pitch-based carbon fiber.

9. A process as set forth in claim 1, wherein the volume content of the pitch-based carbon fiber in the composite material is in the range of 5% to 70%.

10. A process as set forth in claim 1, wherein the carbonization under pressure is carried out at a temperature in the range of 400° to 2,000° C., at a pressure in the range of 50 to 10,000 kg/cm$^2$, using an inert gas.

11. A process as set forth in claim 1, wherein the carbonization under pressure is carried out at a temperature in the range of 400° to 2,000° C., at a pressure in the range of 10 to 500 kg/cm$^2$, using a hot press.

12. A process as set forth in claim 1, wherein the carbonization under pressure is followed by carbonization or graphitization at atmospheric pressure, at a temperature in the range of 400° to 3,000° C., in an inert gas atmosphere.

* * * * *